United States Patent [19]

Hanagata

[11] Patent Number: 5,001,884

[45] Date of Patent: Mar. 26, 1991

[54] PACKAGING MACHINE

[76] Inventor: Toshiyuki Hanagata, 417 Yokouchi, Toyama-shi, Toyama, Japan

[21] Appl. No.: 430,886

[22] Filed: Nov. 2, 1989

[30] Foreign Application Priority Data

Jun. 30, 1989 [JP] Japan ..... 1-170636

[51] Int. Cl.[5] ..... B65B 9/08; B65B 31/04; B65B 57/10

[52] U.S. Cl. ..... 53/58; 53/66; 53/74; 53/511; 53/557; 53/568

[58] Field of Search ..... 53/79, 373, 403, 432, 53/433, 510, 511, 512, 548, 550, 557, 562, 568, 58, 66, 74, 574

[56] References Cited

U.S. PATENT DOCUMENTS

| | | | |
|---|---|---|---|
| 2,753,671 | 7/1956 | DePuy et al. | 53/548 X |
| 3,490,194 | 1/1970 | Monaghan | 53/74 |
| 3,496,700 | 2/1970 | McCabe et al. | 53/550 X |
| 3,583,888 | 6/1971 | Shanklin | 53/568 |
| 4,035,983 | 7/1977 | Shanklin et al. | 53/548 X |
| 4,177,622 | 12/1979 | Siegal et al. | 53/511 |
| 4,219,988 | 9/1980 | Shanklin et al. | 53/550 |
| 4,344,270 | 8/1982 | Andersson | 53/511 |
| 4,548,018 | 10/1985 | Wojnicki | 53/562 X |
| 4,879,863 | 11/1989 | Di Bernardo | 53/568 X |

FOREIGN PATENT DOCUMENTS

| | | |
|---|---|---|
| 2555324 | 7/1976 | Fed. Rep. of Germany . |
| 62-18429 | 12/1987 | Japan . |
| 1474838 | 11/1975 | United Kingdom . |

*Primary Examiner*—Robert L. Spruill
*Assistant Examiner*—Linda B. Johnson
*Attorney, Agent, or Firm*—Frishauf, Holtz, Goodman & Woodward

[57] ABSTRACT

A packaging machine of the type, in which products are inserted into the gap between two halves of center-folded film. The machine comprises two sealers. The first sealer cuts and heat-seals the center-folded film along a line extending at right angles to the fold of the film, thereby forming a bag containing a product. The second sealer heat-seals each bag at the open side thereof which extends parallel to the fold of the film. The machine further comprises a clamper and an evacuator. The clamper clamps the open side of the bag before the bag is sealed completely. The removes air from the bag through the clamper before the bag is sealed completely.

5 Claims, 3 Drawing Sheets

PACKAGING MACHINE

BACKGROUND OF THE INVENTION

FIELD OF THE INVENTION

The present invention relates to a packaging machine for continuously packaging products with synthetic resin film, and in particular to a packaging machine for sealing products by evacuating the bags made of synthetic resin film and containing the products, by means of an evacuator.

The conventional shrink-packaging machine comprises a heat tunnel. Products are inserted, each into a sheet of center-folded film made of synthetic resin. Each sheet of film, containing a product, is heat-sealed at the open side and the open ends, into a bag. The bags containing the products are passed through the heat tunnel, one after another, and are heat-shrinked as they pass through the heat tunnel. Before each bag is passed through the heat tunnel, small holes are made in the bag to allow the passage of air in order to achieve successful shrink-packaging, and a member made of foamed rubber is pressed onto each bag, thereby removing the residual air from the bag.

In another conventional; vacuum-packaging machine, products are inserted into prepared bags made of synthetic resin, and the bags containing the products are evacuated by means of a vacuum pump and then sealed at their open ends.

In the case of the first machine, the small holes of each bag remain open even after the products have been shrink-packaged. Dust or bacilli inevitably enter the package through these holes. Due to these holes, the bags cannot contain liquid, nor can they be used to provide airtight packages.

In the case of the second machine, the products must be inserted into the bags, which requires much time. Further, each bag must be sealed at its open end after the product has been inserted into it. Moreover, bags of different sizes must be prepared for packaging products of different sizes. Obviously, this machine cannot accomplish automatic packaging.

BRIEF SUMMARY OF THE INVENTION

It is an object of the present invention to provide packaging machine which can continuously form evacuated, airtight packages, by using center-folded film.

It is another object of this invention to provide a packaging machine which can easily and quickly form evacuated, airtight packages, by utilizing an L-sealer.

It is a further object of the invention to provide a packaging machine which can continuously forms evacuated, airtight packages, by using a center-folded film made of synthetic resin.

According to a first aspect of the invention, there is provided a packaging machine wherein products are inserted into the gap between two halves of center-folded film, said machine comprising: a first sealer for cutting and heat-sealing the center-folded film along a line extending at right angles to the fold of the film, thereby forming a bag containing a product; a second sealer for hear-sealing each bag at the open side thereof which extends parallel to the fold of the film; a clamper for clamping the open side of the bag before the bag is sealed completely; and an evacuator for removing air from the bag through the clamper before the bag is sealed completely.

According to a second aspect of the present invention, there is provided a packaging machine wherein products are inserted into the gap between the halves of a center-folded film made of synthetic resin, and an L-sealer seals the film at an open side and an open end, said machine comprising: a holder for holding and closing the open side and the open end of the center-folded film before the film is sealed completely by the L-sealer; a clamper located outside the L-sealer, for clamping the open side of the center-folded film such that air is able to pass through the open side; and an evacuator for removing air from the center-folded film through the clamper before the center-folded film is sealed completely by means of the L-sealer.

According to a third aspect of the invention, there is provided a packaging machine wherein products are inserted into the halves of center-folded film made of synthetic resin, said machine comprising: a sealer for heat-sealing the center-folded film at open ends; a clamper for clamping one of the open ends of the center-folded film such that air is able to pass through the open side before the center-folded film is sealed completely by means of the sealer; an evacuator for removing, though the clamper, air from the center-folded film; and a heater for heating the evacuated, sealed film containing a product, thereby to form a shrink-package.

The packaging machine according to the first aspect of the invention can continuously form evacuated, airtight packages, by using center-folded film.

The packaging machine according to the second aspect of this invention can easily and quickly form evacuated, airtight packages, by utilizing an L-sealer.

The packaging machine according to the third aspect of the present invention can continuously form evacuated, airtight shrink packages, by using a center-folded film made of synthetic resin.

DETAILED DESCRIPTION OF THE PREFERRED EMBODIMENTS

Figure 1:
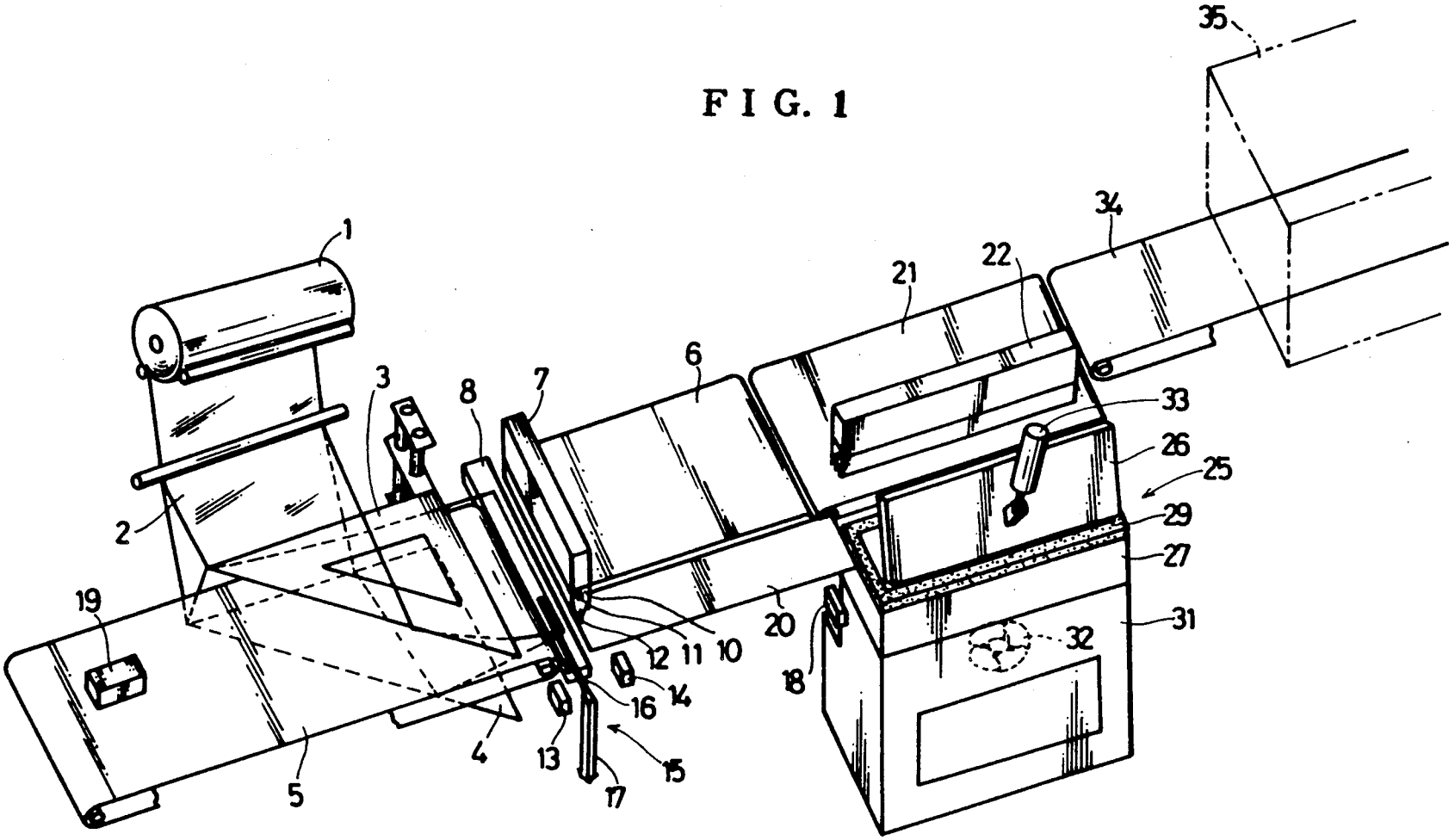
FIG. 1 is a perspective view illustrating a packaging machine which is a first embodiment of this invention.
Figure 2:
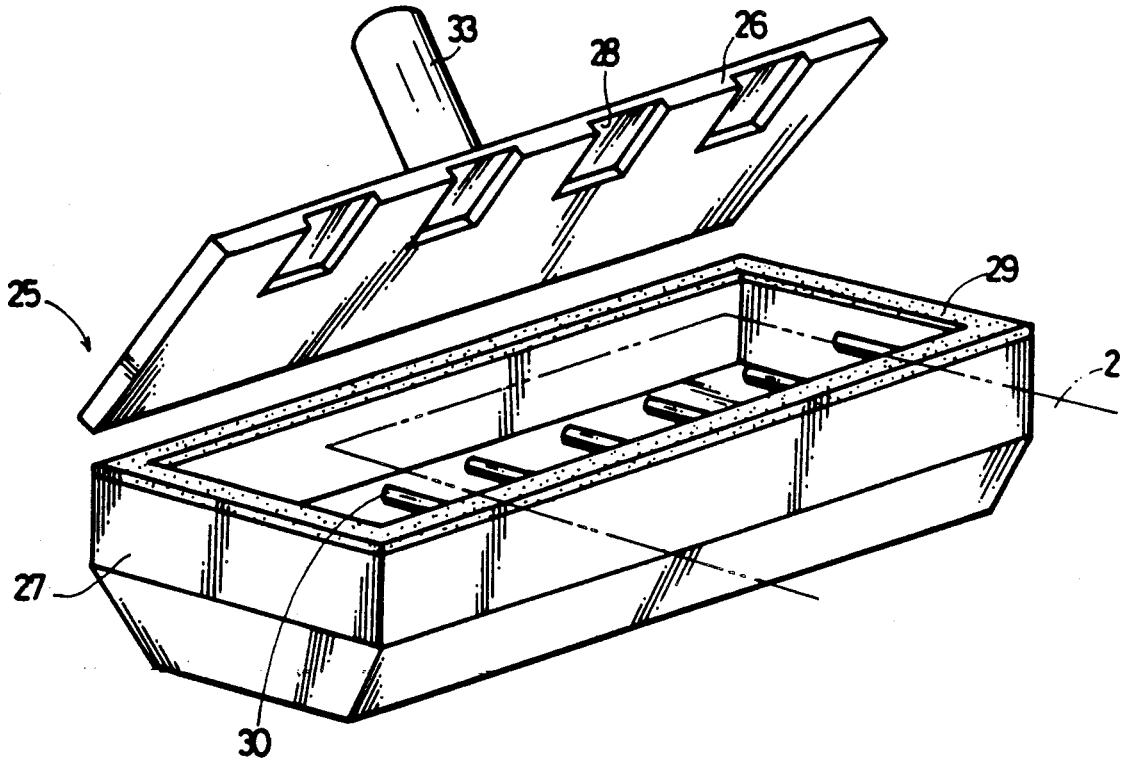
FIG. 2 is a perspective view showing the film clamper incorporated in the machine illustrated in FIG. 1.

FIGS. 1 and 2 illustrates a packaging machine according to a first embodiment of the present invention. The machine has a roll holder. Mounted on the roller holder is a roll 1 of center-folded film 2 made of airtight material such as polyethylence. Film 2 is fed from roll 1 downward to guide plates 3 and 4 located below roll 1. The guide plates 3 and 4 shaped like a right isosceles triangle, and are designed to separate the halves of center-folded film 2 from each other and guide these halves forward in a different direction. Guide plates 3 and 4 are on the opposite sides of first conveyor belt 5 for transporting products. More precisely, plate 3 is located above belt 5, and plate 4 is located below belt 5. Therefore, guide plate 3 guides, at its hypotenuse, the first film-half above belt 5 in the same direction as belt 5 transports the products, whereas guide plate 4 guides, at its hypotenuse, the second film-half below the belt 5 in the same direction as belt 5 transports the products. Second conveyor belts 6 is located near first conveyor belt 5. First sealer 7 and first backing member 8 are located between conveyor belts 5 and 6. First sealer 7 is located above the halves of film 2, and extends across the halves of film 2. First sealer 7 comprises a pair of vertical heat bars 10, pipe heater 11 extending horizontally and held between heat bars 10, and heat-sealing blade 12 extending horizontally and held between heat bars 10. First backing member 8 is located below the halves of film 2, and extends across the halves of film 2. Member 8 comprises a bar coated with heat-resistant rubber. First sealer 7 and first backing member 8 are vertically moved, toward each other and away from each other, by two pneumatic drivers or the like (not shown), respectively.

Between first conveyor belt 5 and second conveyor belt 6, there are provided sensors 13 and 14 to detect the passage of the products. Film-feeding device 15 is located close to second conveyor belt 6, to ensure the supply of film 2 from the first conveyor belt 5 to the second conveyor belt 6. Device 15 comprises horizontal bar 16 inserted in the gap between the halves of center-folded film 2, and a vertical bar 17 holding bar 16 at one thereof. Vertical bar 17 is reciprocated along second conveyor belt 6 by means of a driver (not shown), thereby moving horizontal bar 16. Bar 16, which is inserted in the gap between the film-haves sealed together by first sealer 7, pulls the forward end of the center-folded film 2 toward second conveyor belt 6, as it is moved toward belt 6. Sensor 18 is located at the forward end of second conveyor belt 6, to detect the passage of the products. Guide plate 20 is located beside to second conveyor belt 6, extending parallel to belt 6.

Third conveyor belt 21 is located close to second conveyor belt 6. Second sealer 22 and second backing member 23 are located beside third conveyor belt 21. They are identical in structure to first sealer 7 and first backing member 8, but extend parallel to third conveyor belt 21.

Film clamper 25 is located beside third conveyor belt 21 farther therefrom than second sealer 22. Film clamper 25 is designed to clamp one side of a sheet of film which has been heat-cut from the film 2 by means of first sealer 7 and first backing member 8. As is shown in FIG. 2, film clamper 25 comprises holding plate 26 and box-shaped base 27. Several U-grooves 28 are cut in that edge of holding plate 26 which opposes the side of third conveyor belt 21. Elastic frame 29 made of, for example, foamed rubber is bonded to the top box-shaped base 27. Projections 30 protrude inwardly and horizontally from that side of base 27 which opposes the side of third conveyor belt 21. Projections 30 prevent a sheet of film from bending down when the sheet is clamped between holding plate 26 and box-shaped base 27.

Film clamper 25 is connected to evacuator 31 such that the interior of base 27 communicates with blower 32 incorporated in evacuator 31. The holding plate 26 of film clamper 25 is attached to pneumatic driver 33, and can be moved onto the top of base 27 and away therefrom when driven by pneumatic driver 33.

The operation of the packaging machine described above will now be explained.

First, first sealer 7 seals the forward end of center-folded film 2. Product 19, being carried by first conveyor belt 5, passes through the gap between guide plates 3 and 4 and eventually held between the halves of film 2. Upon detecting the passage of product 19, sensor 13 outputs a signal. In response to this signal, the driver (not shown) moves film-feeding device 15 toward second conveyor belt 6. As a result, film 2 is moved from first conveyor belt 5 onto second conveyor belt 6, together with product 19 held between the halves of film 2.

Then, sensor 14 detects the passage of product 19 and outputs a signal, thereby stopping second conveyor belt 6, and moving first sealer 7 downward and first backing member 8 upward. Film-feeding device 15 has already been moved back to its initial position and placed between the halves of film 2. First sealer 7 and first backing member 8 cooperate, sealing film 2 and cutting the forward-end portion from the portion being fed from roll 1. As a result, a bag opening at one side only is formed. Now that the portion of film 2, being fed from roll 1, has been sealed at its front end, film-feeding device 15 can pull film toward second conveyor belt 6.

Then, second conveyor belt 6 is driven again, thereby transporting the bag containing product 19 toward third conveyor belt 21. Sensor 18 detects the passage of product 19, whereupon third conveyor belt 21 is driven and moves the bag to film clamper 25. When the bag reaches film clamper 25 and is positioned, with its open side set between the holding plate 26 and base 27 of clamper 25, third conveyor belt 21 is stopped.

Next, pueumatic driver 33 is operated, moving holding plate 26 onto base 27. As a result of this, the open side of the bag is clamped between the plate 26 and base 27. Evacuator 31 is operated, thus renoving air from the bag through those portions of the bag which are located in the grooves 28 of plate 26 and are thus opened. Further, projections 30 prevent the side 4 of the bag from bending down. This ensures smooth passage of air from the bag to the evacuator 31.

When the bag is evacuated sufficiently, second sealer 22 is operated, thus heat-sealing the open side of the bag. Then holding blade 26 is moved from base 27 by means of pneumatic driver 33, thus releasing the bag from film clamper 25. Thereafter, third conveyor belt 21 is driven again. The bag is therefore transported onto fourth conveyor belt 34. If there is no need to process the evacuated bag further, the bag is removed from fourth conveyor belt 34. Otherwise, the bag is passed through heater 35, which applies heat to the bag, thus forming a shrink-package containing product 19.

As can be understood from the above, the machine is relatively simple in structure, and can yet continuously form shrink-packages which are sealed and evacuated completely. Since the packages are evacuated, they are less bulky than otherwise.

The shrink-packages made by the machine have no holes remaining open. Hence, neither dust nor bacilli can enter the shrink-packages. The products contained in the packages are, therefore, preserved for a long period of time.

A second embodiment of the invention will be described, with reference to FIG. 3. The same components as those of the first embodiment are designated at the same numerals in FIGS. 1 and 2 and will not be described in detail.

Figure 3:
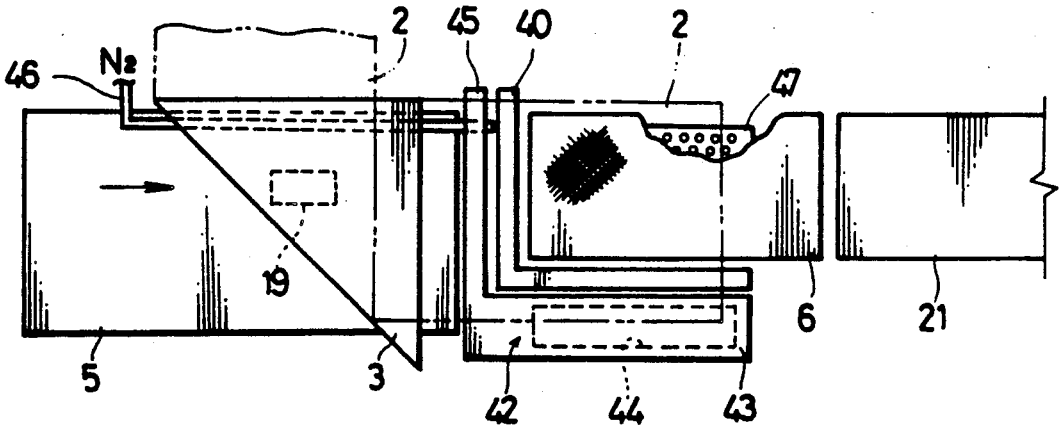
FIG. 3 is a plan view representing a packaging machine which is a second embodiment of this invention.

The packaging machine shown in FIG. 3 is characterized by the use of L-sealer 40. L-sealer 40 performs the same function as first sealer 7 incorporated in the first embodiment, and differs only in shape. It consists of two portions, the first portion extending across center-folded film 2, between first conveyor belt 5 and second conveyor belt 6, and the second portion extending along one side of second conveyor belt 6.

Film clamper 42, which is also L-shaped, is located near L-sealer 40. Clamper 42 consists of two portions. The first portion 45 extends across center-folded film 2, and the second portion extends along the side of second conveyor belt 6. The first portion 45 functions to clamp the end of film 2. Like film clamper 25 used in the first embodiment, the second portion of clamper 42 comprises holding plate 43 and base 44.

A gas-supplying pipe 46 is connected, at one end, to one end of the first portion 45 of clamper 42. Pipe 46 extends through the gap between guide plate 3 and first conveyor belt 5. The other end of pipe 46 is connected to a nitrogen cylinder (not shown).

Second conveyor belt 6 is a meshed belt having a sufficient gas-permeability. Vacuum device 47 is attached to the lower surface of belt 6. Therefore, when vacuum device 47 is driven, film 2 is attracted onto second conveyor belt 6, not slipping from belt 6. This helps conveyor belt 6 transport film 2 to film clamper 42, without fail.

The operation of the second embodiment shown in FIG. 3 will be explained. First, product 19 is mounted onto first conveyor belt 5 which is being driven forward. Eventually, product 19 goes into the gap between the halves of center-folded film 2. When product 19 reaches the sealed end of film 2, film-feeding device 15 pulls film 2 and product 19 toward second conveyor belt 6. A sensor (not shown) detects the passage of product 19, whereupon second conveyor belt 6 and vacuum device 47 are driven. Hence, film 2 is moved toward third conveyor belt 21. A sensor (not shown) detects the passage of product at L-sealer 40, whereupon second conveyor belt 6 is stopped. Then, film clamper 42 is operated, whereby the open end and open side of film 2 are clamped. In this condition, an evacuator (not shown) is driven, thus removing air from film 2 through those portions of the bag which are located in the grooves 28 of plate 26 and are thus opened. After film 2 has been evacuated completely, nitrogen gas is introduced into the film 2 through pipe 46. L-sealer 40 is then operated, thus heat-sealing the clamped end and side of film 2 and forming a bag containing product 19.

Next, second conveyor belt 6 is driven again, thereby transporting the bag onto the third conveyor belt 21. If there is no need to process the evacuated bag further, the bag is remoced from third conveyor belt 21. If the bag needs to be heat-shrinked, it is passed through a heater (not shown), which applies heat to the bag, thus forming a shrink-package containing product 19.

The packaging machine according to the second embodiment is advantageous in that L-sealer 40 seals one open end and the open side of film 2 at the same time. Therefore, the operation efficiency of the machine is high. Further, since L-sealer performs the functions of both sealers 7 and 22, the machine can be smaller than the first embodiment. In addition, since nitrogen gas is introduced into the bag before the bag is completely sealed, product 19 remain free from oxidation, and the package appears more neat and attractive than a shrink-package.

Figure 4:
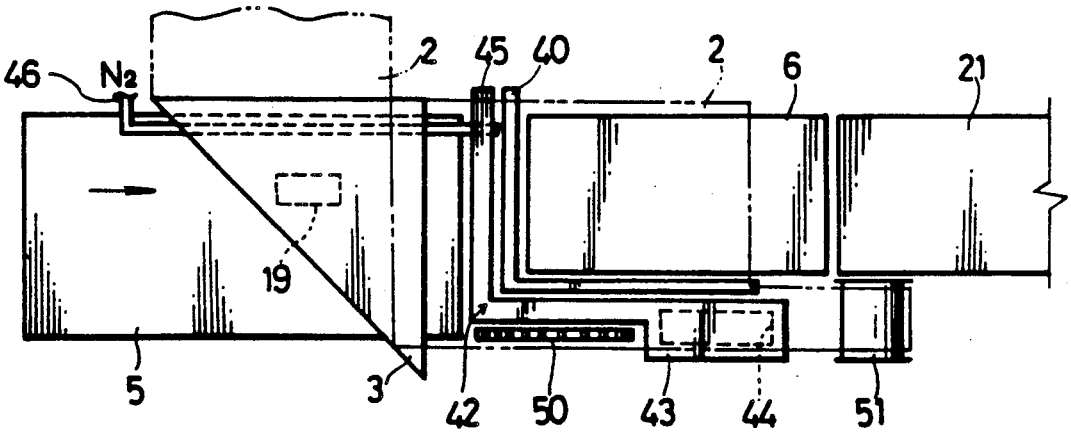
FIG. 4 is a plan view illustrating a packaging machine which is a third embodiment of this invention.

A third embodiment of the invention will discribed, with reference to FIG. 4. The same components as those of the first embodiment are designated at the same numerals in FIG. 4, and will not be described in detail.

The third embodiment also has L-sealer 40, but differs from the second embodiment in that film-feeding device 50 comprising a pair of chains is used to feed centerfolded film 2. Further, the third embodiment has take-up reel 51 for taking up the side portion cut from film 2 by means of L-sealer 40. Film clamper 42 is identical in structure to its equivalent of the second embodiment, except that holding plate 43 and base 44 are narrower, providing a space for film-feeding device 50.

Since center-folded film 2 is fed by the chains of device 50, it is moved forward at constant speed, without fail. In addition, since the side portion of film 2, cut by L-sealer 40, is taken up around reel 51 and can be easily disposed of.

According to the present invention, the evacuator can be a vacuum pump. If this is the case, air can be easily removed from the center-folded film fed from a roll. Further, the film clamper can have any other structure than is shown in FIG. 2, provided that it can remove air form the bag made of the film. When the evacuator is a vacuum pump, it suffices to connect the film clamper to the vacuum pump by a suction pipe or the like. In this case, no openings need be made in the bottom of the base (27) of the clamper, which communicate with the evacuator.

The invention is not limited to the embodiments which have been described. For instance, a nitrogen cylinder can be used also in the first embodiment, thereby to introduce nitrogen gas into the bag, expelling air from the bag.

Any packaging machine according to the invention evacuates a bag made of center-folded film fed from a roll and containing a product, before sealing the bag completely. Therefore, the bag collapses and become less bulky. Moreover, since bags are formed by end-sealing the center-folded film, one after another, the packaging machine can package products continuously, with high efficiency. In addition, to heat-shrink the package, it is no longer necessary to evacuate the package since air has already been removed from the package. Still further, once the bag has been evacuated, it has not holes felt open, and neither dust nor bacilli can enter the bag.

Recently, film has been developed which has an extremely low gas-permeability. Any packaging machine according to the present invention can use this film. When the machine uses this film, it can make greatly airtight packages, with high efficiency.

In recent years, the use of containers made of vinyl chloride has become a problem, from an ecological point of view. The use of containers made of PET, which is harmless to plants and animals, is attracting much attention. However, since PET containers permeate oxygen, they are not suitable for containing products which should not be oxidized. The packaging machine according to this invention can wrap PET containers with film having a low gas-permeability, thus forming adequately airtight packages the contents of which are free of oxidation. The machine can, therefore, encourage the use of harmless PET containers.

What is claimed is:

1. A packaging machine, wherein products are inserted into a gap between two halves of a center-folded film, said machine comprising:

a first conveyor belt for transporting products;

guide plates located on opposite sides of the first conveyor belt for separating and guiding the halves of the center-folded film;

a second conveyor belt located near the terminus of the first conveyor belt;

a first sealer located between the first and second conveyor belts for cutting and heat-seating the center-folded film along a line extending substantially at right angles to the fold of the center-folded film, thereby forming a bag containing a product;

first sensor means located close to the first sealer for detecting products and for controlling operation of the second conveyor belt and operation of the first sealer;

a third conveyor belt located near the terminus of the second conveyor belt;

second sensor means located close to the terminus of the second conveyor belt for detecting products and for controlling operation of the third conveyor belt;

a second sealer located adjacent to a side of the third conveyor belt for heat-sealing each bag at an open side thereof which extends substantially parallel to the fold of the center-folded film;

a clamper located adjacent to a side of the third conveyor belt and being controlled by said second sensor means for clamping the open side of the bag before the bag is completely sealed by the second sealer; and evacuator means for removing air from the bag through said clamper before the bag is completely sealed by the second sealer.

2. The packaging machine according to claim 1, further comprising:

a film-feeding device for feeding the film, which has been sealed at a forward end, from said first sealer to said second sealer; and third sensor means located close to the terminus of the first conveyor belt for detecting products and for controlling operation of the film-feeding device.

3. The packaging machine according to claim 1, further comprising a gas-supplying device for introducing nitrogen gas into the film while air is being removed from the film by means of said evacuator means.

4. A packaging machine, wherein products are inserted into two halves of a center-folded film made of synthetic resin, said machine comprising:

a first conveyor belt for transporting products;

guide plates located on opposite sides of the first conveyor belt for separating and guiding the halves of the center-folded film;

a second conveyor belt located near the terminus of the first conveyor belt;

a first sealer located between the first and second conveyor belts for heat-sealing the center-folded film at open ends extending substantially at right angles to the fold of the center-folded film;

first sensor means located close to the first sealer for detecting products and for controlling operation of the second conveyor belt and operation of the first sealer;

a third conveyor belt located near the terminus of the second conveyor belt;

second sensor means located close to the terminus of the second conveyor belt for detecting products and for controlling operation of the third conveyor belt;

a second sealer located adjacent to a side of the third conveyor belt for heat-sealing an open side which extends substantially parallel to the fold of the center-folded film;

a clamper located adjacent to a side of the third conveyor belt and being controlled by said second sensor means for clamping the center-folded film such that air is passable through an open side of the film before the center-folded film is sealed completely by means of said second sealer;

evacuator means for removing, through the clamper, air from the center-folded film; and heater means for heating the evacuated, sealed film containing a product, to thereby form a shrink-package.

5. The packaging machine according to claim 4, further comprising a gas-supplying device for introducing nitrogen gas into the film while air is being removed from the film by means of said evacuator means.

* * * * *